United States Patent [19]

Håkanson

[11] Patent Number: 4,480,376

[45] Date of Patent: Nov. 6, 1984

[54] THERMISTORS, THEIR METHOD OF PRODUCTION

[75] Inventor: Bo H. Håkanson, Lund, Sweden

[73] Assignee: Crafon Medical AB, Sweden

[21] Appl. No.: 367,932

[22] Filed: Apr. 13, 1982

[30] Foreign Application Priority Data

Apr. 15, 1981 [SE] Sweden ..... 8102428

[51] Int. Cl.[3] ..... H01C 17/00; H01C 17/06

[52] U.S. Cl. ..... 29/593; 29/612; 29/620; 338/22 R; 338/203; 427/101

[58] Field of Search ..... 338/22 R, 22 SD, 23–28, 338/203; 29/612, 620, 593; 427/101, 102

[56] References Cited

U.S. PATENT DOCUMENTS

| | | | |
|---|---|---|---|
| 2,781,277 | 2/1957 | Dwyer | 427/293 |
| 4,278,706 | 7/1981 | Barry | 29/620 |
| 4,302,972 | 12/1981 | Oettle et al. | 538/22 R |
| 4,382,246 | 5/1983 | Hånsson et al. | 338/22 R |

FOREIGN PATENT DOCUMENTS

| | | | |
|---|---|---|---|
| 2623606 | 12/1977 | Fed. Rep. of Germany | 29/620 |
| 2645783 | 4/1978 | Fed. Rep. of Germany . | |
| 796357 | 6/1958 | United Kingdom | 338/203 |
| 1470630 | 4/1977 | United Kingdom | 29/620 |

*Primary Examiner*—C. L. Albritton

*Assistant Examiner*—C. N. Sears

*Attorney, Agent, or Firm*—Lerner, David, Littenberg, Krumholz & Mentlik

[57] ABSTRACT

Methods for producing thermistors having predetermined resistance values at predetermined temperatures are disclosed. The methods include providing a sheet of electrically non-conductive material, applying a layer of electrically conductive material to the sheet in a repeating, spaced pattern so as to produce a number of electrically conductive material portions and at least one space between them, applying a layer of thermistor material to that space in order to bridge the pairs of electrically conductive material portions and produce at least one thermistor strip having a substantially constant resistance value along its length, measuring the resistance of the thermistor strip between the pairs of electrically conductive material portions, determining from the measured resistance value the length of the thermistor strip required to produce a thermistor having the predetermined resistance value at the predetermined temperature, and producing a plurality of thermistors from the thermistor strip by transversely dividing the strip in accordance with the required lengths. In addition, thermistors produced by this method are also disclosed, as are thermometers which include these thermistors.

12 Claims, 6 Drawing Figures

THERMISTORS, THEIR METHOD OF PRODUCTION

FIELD OF THE INVENTION

The present invention relates to methods for producing thermistors having predetermined resistance values at predetermined temperatures. More particularly, the present invention relates to methods for producing thermistors which are preferably intended for measuring temperatures. More particularly, the present invention relates to thermistors produced by such a method. Still more particularly, the present invention relates to thermometers containing thermistors produced by such a method.

BACKGROUND OF THE INVENTION

Thermometers which utilize thermistors for temperature determinations have been developed for the principal purpose of measuring temperatures in medical applications. Therefore, in such cases an effort must be made to keep production of the thermistors, and the thermometers produced therefrom, simple and cheap enough so that the thermometers can be thrown away after use. That is, it must be possible to discard the thermometers and not reuse them.

At the same time, it still remains necessary to be able to produce these thermistors and thermometers with the required degree of accuracy and so that the temperature value read therefrom can be relied upon, as is of course of great significance in the medical field. Those having knowledge of this business will understand that thermometers made in accordance with this invention can also be used in other connections, such as for purely industrial applications where a simple and cheap thermometer can be prepared but which remains capable of producing a reliable temperature reading.

In U.S. Pat. Nos. 4,317,367; 4,296,633 and 4,253,334; and in U.S. patent application Ser. No. 196,079, which was filed on Sept. 25, 1980, now U.S. Pat. No. 4,382,246 several designs for thermometers are described in which a thermistor is used, and in which thermistors made in accordance with the present invention could be utilized. Furthermore, U.S. Pat. Nos. 4,200,970 and 4,236,298 disclose processes for adjusting thermistors which are to be fitted as temperature sensors in other thermometer designs therefor. However, these and other known processes for adjusting thermistors and the like suffer from the disadvantage that heat is developed in any mechanical processing utilized in order to adjust the electrical property, such as resistance, of the temperature sensitive portions of these sensors. Thus, it becomes quite difficult to measure these properties as a control at a precisely predetermined temperature.

Furthermore, British Pat. No. 796,357 discloses another process for manufacturing resistors from a composite web which is produced from superimposed ribbons of resinous material having conductive material dispersed therein, as shown in FIG. 1 thereof. These ribbons are then cut into strips m by guillotine 1, and their resistances are then measured. A feedback control unit p is then used to vary the size of the sliced strips in response thereto.

It is an object of the present invention to remove or at least reduce the dependence on the relatively complicated adjustment processes of the prior art. This is now done by providing additional accuracy in the manufacturing process, which can also now be carried out in combination with a simple sorting process for combining two or more sensors in accordance with a method which is similar to that of U.S. Pat. No. 4,302,972.

BRIEF SUMMARY OF THE INVENTION

In accordance with the present invention, these and other objects have now been accomplished. Thus, in accordance with the method of the present invention thermistors having a predetermined resistance value at a predetermined temperature are produced by providing a sheet of electrically non-conductive material, applying a layer of electrically conductive material to that sheet of electrically non-conductive material in a repeating, spaced pattern so as to produce a plurality of electrically conductive material portions and at least one space therebetween, applying a layer of thermistor material to that at least one space between the plurality of electrically conductive material portions on the sheet of electrically non-conductive material so as to bridge that space and thus produce at least one thermistor strip having a substantially constant resistance value along its length, the at least one thermistor strip comprising the layer of thermistor material applied to the space and a pair of the electrically conductive material portions on either side thereof, measuring the resistance value for the at least one thermistor strip across the pair of electrically conductive material portions, determining the measured resistance value, the length of the thermistor strip required to produce a thermistor having the predetermined resistance value at the predetermined temperature and producing a plurality of thermistors from the thermistor strip by transversely dividing the thermistor strip in accordance with that required length.

In accordance with one embodiment of the method of the present invention, the method includes applying the layer of electrically conductive material to the sheet of electrically non-conductive material in the aforementioned repeating, spaced pattern in order to produce the plurality of electrically conductive material portions and a plurality of spaces therebetween, applying a plurality of layers of the thermistor material to that plurality of spaces, and producing a plurality of the thermistor strips therefrom. In accordance with a preferred embodiment thereof, the layers of electrically conductive material and of thermistor material are applied to the sheet of electrically non-conductive material by means of printing, and preferably these layers are applied in the form of parallel, partly overlapping strips.

In accordance with another embodiment of the method of the present invention, the plurality of thermistor strips are produced by dividing the sheet of electrically non-conducting material at locations within the plurality of electrically conductive layer portions, and in a direction substantially parallel to the parallel, partly overlapping strips. Preferably, the plurality of thermistors are produced by transversely dividing the thermistor strip in a direction substantially perpendicular to the parallel, partly overlapping strips.

In accordance with another embodiment of the method of the present invention, the layers of electrically conductive material and of thermistor material are applied to a first side of the sheet of electrically non-conductive material, that sheet includes a second side, and different colors are applied to the first and second sides thereof so as to facilitate subsequent handling or positioning thereof.

In accordance with a preferred embodiment of the method of the present invention, the plurality of thermistors are produced in a rectangular shape. Preferably, in this embodiment the plurality of electrically conductive material portions include parallel strips and the layer of thermistor material bridges the spaces therebetween, whereby the thermistor strip includes the pair of substantially parallel strips of electrically conductive material portions located along opposite edges thereof.

In accordance with another embodiment of the method of the present invention, the method includes combining pairs of the plurality of thermistors by juxtaposing one of each of the pairs of substantially parallel strips of the electrically conductive material portions on each of the pairs of thermistors. In embodiments thereof, the pairs of thermistors are connected in parallel, or in series. Preferably, combination of the pairs of the pluralities of thermistors includes measuring the resistance value for the plurality of thermistors, sorting the thermistors into a plurality of batches of thermistors, each batch thus having a resistance value within a predetermined resistance value range, and selecting the pairs of thermisters by combining thermisters selected from a predetermined pair of the batches in order to produce a combined pair of thermisters having a predetermined combined resistance value.

In accordance with the present invention, a thermister is also provided having a predetermined resistance value at a predetermined temperature. The thermistor hereof includes an electrically non-conductive base member including first and second parallel edge portions defining a longitudinal length therefor, a pair of layers of electrically conductive material applied to the electrically non-conductive base member along the first and second parallel edge portions, and a layer of thermister material applied to the electrically non-conductive base member bridging the pair of layers of electrically conductive material, the thermister having a longitudinal length preselected so as to produce a thermistor having the predetermined resistance value at the predetermined temperature. In a preferred embodiment, the layers of electrically conductive material and the layer of thermistor material comprise thick films applied to the electrically non-conductive base member by means of printing.

In accordance with one embodiment of the thermistor of the present invention, the pairs of layers of electrically conductive material and the layer of thermistor material are applied to a first side of the electrically non-conductive base member, the electrically non-conductive base member includes a second side, and different colors are applied to the first and second sides thereof so as to facilitate subsequent handling in positioning thereof.

In a preferred embodiment of the thermister of the present invention, the thermistor has a rectangular shape.

In accordance with another embodiment of the thermistor of the present invention, a pair of electrically non-conductive base members are included, each including the first and second parallel edge portions defining a longitudinal length therefor, a pair of layers of electrically conductive material applied along the first and second parallel edge portions thereof, and a layer of thermistor material bridging the pairs of layers of electrically conductive material, the pair of electrically non-conductive base members combined in a manner so that the first edge portions of each are juxtaposed so as to produce a combined electrically conductive portion. The pairs of electrically non-conductive base members are juxtaposed so that the thermistor portions are connected either in parallel or in series.

In accordance with another embodiment of the thermistor of the present invention, the pairs of electrically non-conductive base members including the pairs of layers of electrically conductive material and layers of thermistor material thereon are selected by measuring the resistance values for the plurality of thermistors, sorting the plurality of thermistors into a plurality of thermistor batches, each having a resistance value within a predetermined resistance value range, and selecting the pairs of thermistors by combining thermistors selected from a predetermined pair of those batches in order to produce a combined pair of thermistors having a predetermined combined resistance value.

In accordance with another embodiment of the present invention, a thermometer is provided which comprises a thermistor having a predetermined resistance value at a predetermined temperature comprising an electrically non-conductive base member including first and second parallel edge portions defining a longitudinal length therefor, a pair of layers of electrically conductive material applied to the electrically non-conductive base member along those first and second parallel edge portions, and a layer of thermistor material applied to the electrically non-conductive base member bridging the pairs of layers of electrically conductive material, the thermistor having a longitudinal length preselected so as to produce a thermistor having the predetermined resistance value at the predetermined temperature, an outer heat-conductive wrapping encasing the thermistor, the outer heat-conductive wrapping being electrically non-conductive, a pair of electrically conductive lead members attached to the pair of layers of electrically conductive material, and access means for obtaining access to that pair of lead members through the outer heat-conductive wrapping so that they can be connected to a measuring device.

The method according to the present invention can thus be characterized by the fact that the resistance between the two contacts or layers of electrically conductive material, or with respect to their dependent or similar parts, is first measured, and that afterwards final cutting or production of the thermistors is carried out in accordance with that measurement.

It is preferred that the layers of electrically conductive material and of thermistor material be applied by printing in the form of parallel lines, partly overlapping each other. Subsequently, the overall sheet of electrically non-conductive material, including these parallel lines, can then be initially cut in a direction parallel with these parallel lines, and at a location within the layers of electrically conductive material, so that the subsequent or final cutting and production of individual thermistors can then be made across or perpendicular to these parallel lines, again dependent upon the prior measurement of the resistance value thereacross. It is preferred in this regard that the layer of electrically conductive material be printed first, and that the layer of thermistor material be printed thereafter.

The resistance is normally measured between the separated pairs of contiguous layers of electrically conductive materials. This measurement can thus be said to take place between the two remaining contact materials or the dependent parts of the layer of electrically conductive material. Known thick film techniques are thus capable of being perfected to a degree such that ultimately measurement need only take place between two arbitrary, adjacent, parallel lines of contact on each of the base plates, i.e., of electrically non-conductive material. Measurement can thus be said to be carried out between the two contacts on similar parts of the layers of electrically conductive material. Naturally, the degree of accuracy to which the measurement shall be made will also depend on the final tolerance desired for the finished product.

It is also noted that in order to simplify later work on or use of these thermistors, different colors can be given to the upper and lower surfaces thereof. Such later work or handling can also be simplified by manufacturing the thermistors in a rectangular shape, as opposed to a square shape. When utilizing a rectangular shape, the covering or printing on the electrically non-conductive base member can be carried out in such a way that the contact material or layer of electrically conductive material fills in two strip shaped portions along two opposite edges of the thermistor, while the intermediate strip shaped portion is then filled in with the layer of thermistor material. In this manner, the length of these parts can then be determined with respect to the resistance measurement made thereacross.

In order to completely eliminate the need for any adjustment, two or more thermistors can be joined together by joining one of the strip shaped layers along the edge of each of a pair of thermistors, in order to produce a double thermistor. This can be done either by connection in series or in parallel. Adjustment is thus avoided by first measuring and sorting a large number of thermistors. They are thus sorted with respect to the measured resistance value into sets or batches, each having a resistance value falling within a precisely defined limit. Subsequently, pairs of thermistors are combined and joined together so that the resultant double thermistor has the required combined resistance by means of one of the thermistors deviating from a normal value being offset by the other thermistors similar but opposite deviation from that normal value.

According to this invention, the thermistors or double thermistors themselves are made by this method. Furthermore, the present invention also includes a thermometer which contains such a thermistor or double thermistor, and which is contained in an outer wrapping consisting of a heat conducting but electrically insulating material, which is connected by its contacts to a pair of leads accessible from the outside thereof, and by means of which they can be connected to a measuring device for measurement of the electrical resistance in relation to the temperature. Such an arrangement for making temperature measurements is described, for example, in U.S. Pat. No. 4,253,334.

BRIEF DESCRIPTION OF THE DRAWINGS

The present invention may be more fully understood with reference to the following drawings and detailed description thereof, in which.

DETAILED DESCRIPTION

As an example of the material used as a layer of thermistor material in accordance with this invention, reference can be made to such materials sold by Electro Materials Corporation of America under the designation "5000-1 TM Thermistor Inks," which have the following typical properties:

| Resistance | Name | TCR ppm/°C. |
|---|---|---|
| 300 Ω/sq | 5032-1 TM | −7000 ± 500 |
| 1K | 5013-1 TM | −8500 ± 500 |
| 10K | 5014-1 TM | −9500 ± 500 |
| 100K | 5015-1 TM | −9500 ± 500 |
| 1 Meg | 5016-1 TM | −9500 ± 500 |

Figure 1:
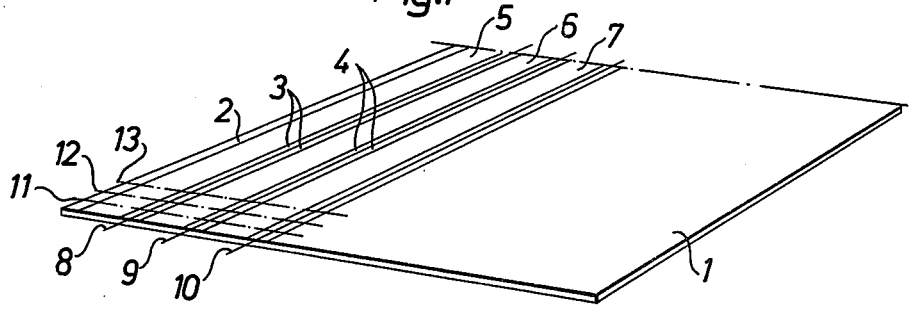
FIG. 1 is a partial, top, perspective, partially schematic view of a base member including thick film printed layers for dividing into thermistors in accordance with the present invention.
Figure 2:
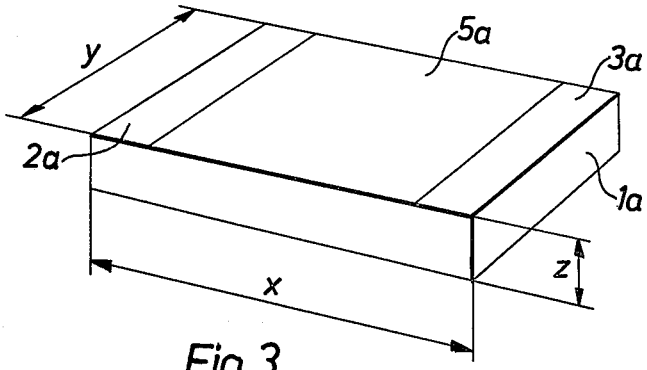
FIG. 2 is a front, elevational view of a thermistor made according to the present invention.

Referring to the figures, in which like numerals refer to like portions thereof, FIG. 1 shows a base plate or member 1 made from an electrically non-conductive material, such as aluminum oxide. According to this invention, and as shown in FIG. 1, a portion of a pattern of an electrically conductive material is shown as having been printed on the base plate, and as well a portion of the thermistor material is printed thereon. The electrically conductive material can be material such as silver. As shown in FIG. 1, the pattern for the electrically conductive material is represented by lines 2, 3, 4, etc., and the pattern for the thermistor material is represented by the broader lines, namely lines 5, 6, and 7. The two patterns can be printed in a random order. It is only important that portions of the base plate which are not covered by the layers of electrically conductive material are bridged by a layer of the thermistor material. The base plate 1 can then be divided into long, longitudinal strips along lines 8, 9, and 10 as shown therein. It has been shown that such a division can be carried out such that each strip has important, unchanged electrical properties along its entire length. As a result, it is therefore possible to measure the resistance between, for example, contact lines 2 and 3, and to then divide up the strips along the dividing lines 11, 12, and 13 in relation to the results obtained by that measurement. By means of such a division, thermistors are thus obtained which have the general shape shown in FIG. 2. These thermistors thus consist of a base plate 1*a*, two contacts 2*a* and 3*a*, as well as the printed portion of thermistor material 5*a*. In practice, dimensions x and z as shown in FIG. 2 are kept essentially constant, and generally are about 1.5 mm and about 0.5 mm, respectively. On the other hand, the dimension y will vary in relation to the resistance value measured, and generally in practice this value will lie around 1 mm ±10%.

The patterns of these materials are preferably applied by means of screen printing, with the initial material being permitted to harden before application of the second material. After the second material has hardened, the plate can be partially covered by an electrically insulating protective layer, and as a result thereof only the parts of the contact material which are later to be used as contacts are left free. This in turn simplifies subsequent soldering of contact threads or leads thereto, etc. Furthermore, the patterns of both materials are printed with an overlap so that ordinary contact is maintained between the contact material or the thermistor material. With respect to specific hardening temperatures, film thicknesses, etc. reference can be made to the respective supplier's known instructions therefor.

Figure 3:
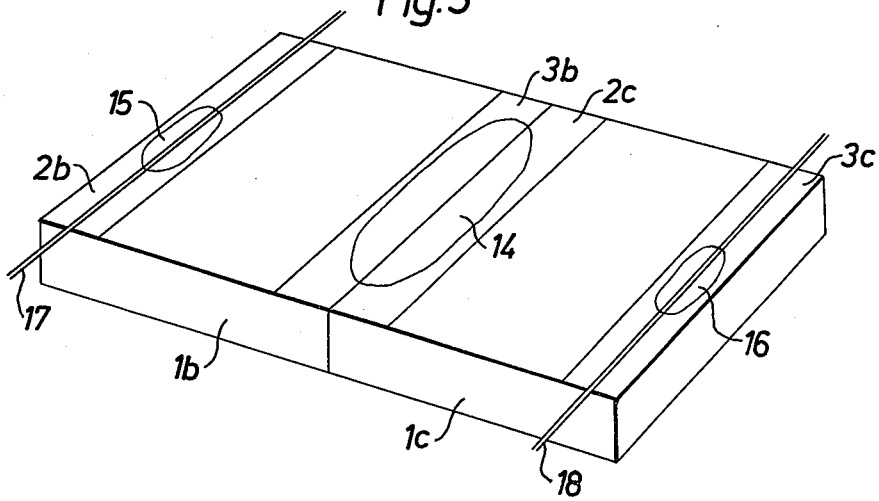
FIG. 3 is a front, elevational, perspective view of a double thermistor made in accordance with the present invention.

Referring to FIG. 3, a double thermistor made in accordance with this invention is shown. This double thermistor is composed of two base plates 1*b* and 1*c*, which are combined by joining contacts 3*b* and 2*c* by soldering, as shown at 14. Furthermore, by solderings 15 and 16 contacts 2*b* and 3*c* are then connected with contact leads 17 and 18.

Figure 4:
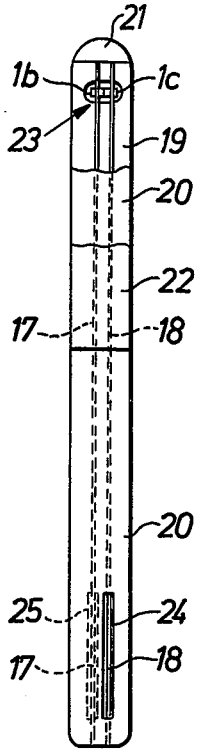
FIG. 4 is a top, elevational, partially sectional view of a thermometer made utilizing the thermistors of the present invention.
Figure 5:
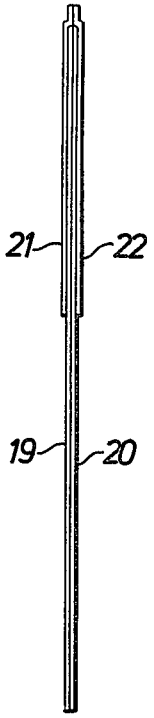
FIG. 5 is a side, elevational view of the thermometer of FIG. 4.
Figure 6:
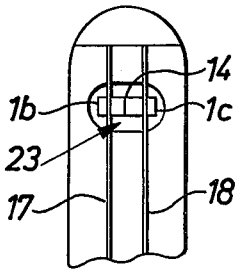
FIG. 6 is a top, elevational, enlarged view of the top portion of the thermometer shown in FIG. 4.

The double thermistor shown in FIG. 3 can be used to produce a thermometer, since the resistance between the contact leads 17 and 18 will vary in relation to the temperature. However, in practice it is adapted to be included as part of a more complete thermometer as shown in FIGS. 4–6. This thermometer thus includes, in addition to the thermistors 1*b* and 1*c* and leads 17 and 18, two base layers 19 and 20 as well as two outer layers 21 and 22, all of which are made, for example, of plastic coated paperboard. Also, at one end of the base layer, a punched hole 23 is provided, while at the other end similarly punched holes 24 and 25 are provided, with a small amount of lateral displacement. Leads 17 and 18 are thus always accessible through these punched holes 24 and 25 in order to enable contact with a measuring device, which is required in order to measure the temperature therefrom.

The hole 23 at the front end of the thermometer is confomed to facilitate attachment of double thermistors of the type shown in FIG. 3. This hole can then be covered by outer layers 21 and 22 so that the thermistors are electrically insulated between these layers.

A more detailed description of the manufacture of the thermometers made according to FIGS. 4–6 can be found in the aforementioned U.S. Pat. No. 4,382,246.

As will be understood by those skilled in this art, this invention is not limited to the above-described manufacturing techniques, but can be varied within the framework of the patent claims set forth below. As an example, one could replace the double thermistors with single thermistors in the overall manufacturing design set forth in FIGS. 4–6 if the process according to this invention is refined to a degree such that sufficiently high tolerances can be justified.

In addition, reference is also made to U.S. patent application Ser. No. 367,931 entitled "Temperature Measuring Sensors and Methods for Adjusting Same" filed on the same date as this application, and which describes an alternative to this invention having many common points.

It will be understood that the embodiment described herein is merely examplary and that a person skilled in the art may make many variations and modifications without departing from the spirit and scope of the invention. All such modifications and variations are intended to be included within the scope of the invention as defined in the appended claims.

What is claimed is:

1. A method for producing thermistors having a predetermined resistance value at a predetermined temperature, comprising a sheet of electrically non-conductive material, applying a layer of electrically conductive material to said sheet of electrically non-conductive material in a repeating, spaced pattern so as to produce a plurality of electrically conductive material portions and a plurality of spaces therebetween, applying a plurality of layers of thermistor material to said plurality of spaces between said plurality of electrically conductive material portions on said sheet of electrically non-conductive material so as to bridge said plurality of spaces between said plurality of electrically conductive material portions and produce a plurality of thermistor strips having a substantially constant resistance along their length, said plurality of thermistor strips comprising said layers of thermistor material applied to said plurality of spaces and a pair of electrically conductive material portions on either side thereof, measuring the resistance value of said plurality of thermistor strips across said pair of electrically conductive material portions, determining from said measured resistance values the length of said thermistor strip required to produce a thermistor having said predetermined resistance value of said predetermined temperature and producing a plurality of thermistors from said plurality of thermistor strips by transversely dividing said thermistor strips in accordance with said required lengths.

2. The method of claim 1 including applying said layer of electrically conductive material and said layer of thermistor material to said sheet of electrically non-conductive material by printing.

3. The method of claim 1 including applying said layer of electrically conductive material and said layer of thermistor material to said sheet of electrically non-conductive material in the form of parallel, partly overlapping strips.

4. The method of claim 3 including producing said plurality of thermistor strips by dividing said sheet of electrically non-conductive material at locations within said plurality of electrically conductive layer portions, and in a direction substantially parallel to said parallel, partly overlapping strips.

5. The method of claim 4 including producing said plurality of thermistors by transversely dividing said thermistor strip in a direction substantially perpendicular to said parallel, partly overlapping strips.

6. The method of claim 1 including applying said layers of electrically conductive material and said thermistor material to a first side of said sheet of electrically non-conductive material, and wherein said sheet of electrically non-conductive material includes a second side, and applying different colors to said first and second sides of said sheet of electrically non-conductive material so as to facilitate subsequent handling thereof.

7. The method of claim 1 including producing said plurality of thermistors in a rectangular shape.

8. The method of claim 7 including applying said plurality of electrically conductive material portions to said sheet of electrically conductive material in substantially parallel strips, and applying said layer of thermistor material so as to bridge said plurality of spaces therebetween, whereby said at least one thermistor strip includes said pair of said substantially parallel strips of said electrically conductive material portions located along opposite edges thereof.

9. The method of claim 8 including combining pairs of said plurality of thermistors by juxtaposing one of each of said pairs of said substantially parallel strips of said electrically conductive material portions on each of said pairs of said thermistors.

10. The method of claim 9 wherein said pairs of thermistors are connected in parallel.

11. The method of claim 9 wherein said pairs of thermistors are connected in series.

12. The method of claims 9, 10, or 11 including combining said pairs of said plurality of thermistors by measuring the resistance values for said plurality of thermistors, sorting said plurality of thermistors into a plurality of batches of said thermistors, each of said batches having a resistance value within a predetermined resistance value range, and selecting said pairs of said thermistors by combining thermistors selected from a predetermined pair of said batches so as to produce a combined pair of said thermistors having a predetermined combined resistance value.

* * * * *

UNITED STATES PATENT AND TRADEMARK OFFICE

CERTIFICATE OF CORRECTION

PATENT NO. : 4,480,376

DATED : November 6, 1984

INVENTOR(S) : Hakanson

It is certified that error appears in the above-identified patent and that said Letters Patent is hereby corrected as shown below:

On the title page, the Assignee should read --Gambro Crafon Aktiebolog--.

Signed and Sealed this

Twenty-fifth Day of January, 1994

*Attest:*

Bruce Lehman

BRUCE LEHMAN

*Attesting Officer*

*Commissioner of Patents and Trademarks*